US005842442A

United States Patent [19]

Marr

[11] Patent Number: 5,842,442

[45] Date of Patent: Dec. 1, 1998

[54] ANIMAL TREATMENT APPARATUS

[76] Inventor: David Marr, Stables, Kempton Park Race Course, Sunbury on Thames, Middlesex, United Kingdom

[21] Appl. No.: 975,629

[22] Filed: Nov. 21, 1997

[30] Foreign Application Priority Data

Nov. 21, 1996 [GB] United Kingdom ..... 9624243
Jun. 3, 1997 [GB] United Kingdom ..... 9711426

[51] Int. Cl.[6] ..... A61D 7/00

[52] U.S. Cl. ..... 119/665; 239/152

[58] Field of Search ..... 119/604, 653, 119/665, 667, 670, 671; 239/152, 153; 601/155, 159, 160, 161, 166

[56] References Cited

U.S. PATENT DOCUMENTS

| | | | |
|---|---|---|---|
| 531,303 | 12/1894 | Christopher | 119/671 X |
| 1,879,915 | 9/1932 | Smoot | 119/665 |
| 3,916,911 | 11/1975 | Sauder et al. . | |
| 4,090,507 | 5/1978 | Van Horn | 601/166 |
| 4,341,183 | 7/1982 | Metzler . | |
| 4,836,144 | 6/1989 | Cole | 119/665 X |
| 5,167,227 | 12/1992 | Meserlian | 128/64 |
| 5,493,996 | 2/1996 | Verschuere et al. | 119/604 X |
| 5,630,379 | 5/1997 | Gerk et al. | 119/667 |

FOREIGN PATENT DOCUMENTS

| | | |
|---|---|---|
| 88 03 706 | 6/1988 | Germany . |
| 89 00 025 | 3/1989 | Germany . |
| 1 560 871 | 2/1980 | United Kingdom . |
| 2 178 665 | 2/1987 | United Kingdom . |

*Primary Examiner*—Robert P. Swiatek
*Assistant Examiner*—James S. Bergin
*Attorney, Agent, or Firm*—Stroock & Stroock & Lavan

[57] ABSTRACT

An animal treatment apparatus comprises a shallow trough (3) in which at last an injured leg (33) of the animal (5) an be located, a container (47) for containing water, a nozzle (53) for aiming the water at an injured area of an animal's body, attachment means (39, 41) for attachment of the nozzle (53) to the animal's body such that the nozzle (53) can remain correctly aligned even if the animal (5) moves, conveying means (31, 45) for conveying the water from the container (47) to the nozzle (53), the trough (3) being arranged to collect the water after it has been sprayed on to the animal's body and return means (15, 17) for returning the water from the trough (3) to the container (47).

24 Claims, 3 Drawing Sheets

ANIMAL TREATMENT APPARATUS

This invention relates to animal treatment apparatus and more particularly but not exclusively to treatment apparatus for use in treating limb injuries.

Particularly in the field of horse racing or other equestrian sports, there are many occasions where an horse can become injured. In particular, torn tendons, ligaments and muscles can be serious and, if not successfully treated in a short time, can become inflamed to the point that the horse has to be put down.

With these tear and strain injuries, the biggest cause of problems is that the injured limb swells up and the resulting inflammation can be fatal. It is therefore essential to keep the swelling down.

The usual treatment for such injuries in the initial stages is the application of cold to the injured area. In humans, one would resort to the use of ice packs which could be assembled around the injured area to reduce the swelling. However, in the case of horses or other animals, such an expedient is not successful since it requires total immobility of the wounded area and the ability to retain ice packs on a limb which will be vertical.

Therefore, other expedients have been tried such as the hosing down of the injured area with cold water. This has the disadvantage that someone has to actually carry out the spraying on a limb which is moving about, thus requiring concentration to maintain the spray on the injured area. Furthermore, this operation is very wasteful of water.

The present invention seeks to provide an apparatus for animal treatment in which some or all of the above disadvantages are obviated or substantially overcome.

According to the invention, there is provided an animal treatment apparatus comprising a container for containing water, a nozzle for aiming the water at an injured area of an animal's body, means for attachment of the nozzle to the animal's body so that the nozzle remains correctly aligned even if the animal moves, means for conveying the water from the container to the nozzle, means for collecting the water after it has been sprayed on to the animal's body and means for returning the water thus collected to the container.

Where the apparatus is intended for the treatment of an animal's limb, the attachment means may be designed for attachment to the limb.

The water may be hot or cold.

Preferably the container carries ice therein so that the water is cooled on each circulation thereof Suitably a plurality of nozzles are used, aimed in different directions so as to increase the area which is covered by the cold water.

The nozzle(s) may be provided along a flexible piping which can be bent to pass substantially around the animal's limb, the piping being suspended from a harness attached to the animal's limb. Alternatively individual nozzle members, each carrying a nozzle, may be connected together by flexible piping such that the piping, together with the nozzle members, can be bent to pass substantially around the limb of an animal. The nozzle members may be independently adjustable so that the streams of water provided thereby can be directed individually.

Suitably, the harness may be open at one side, the two ends of the harness being secured together by means of a buckle arrangement, VELCRO or the like.

The means for collecting the cold water may comprise a shallow trough in which at least the injured leg of the animal is located, the floor of the trough being arranged to drop towards a drain hole suitably located. For use with quadrupeds, the trough may be large enough to take the whole animal or the front or back legs.

The trough may be located at the end of a ramp up which the animal walks to gain access thereto.

Restraining means may be provided to retain the animal in location in respect to the trough.

A plurality of nozzle means may be provided, each for treating one of a plurality of areas of an animal.

The invention will now be described in greater detail, by way of example with reference to the drawings, in which.

Figure 1:
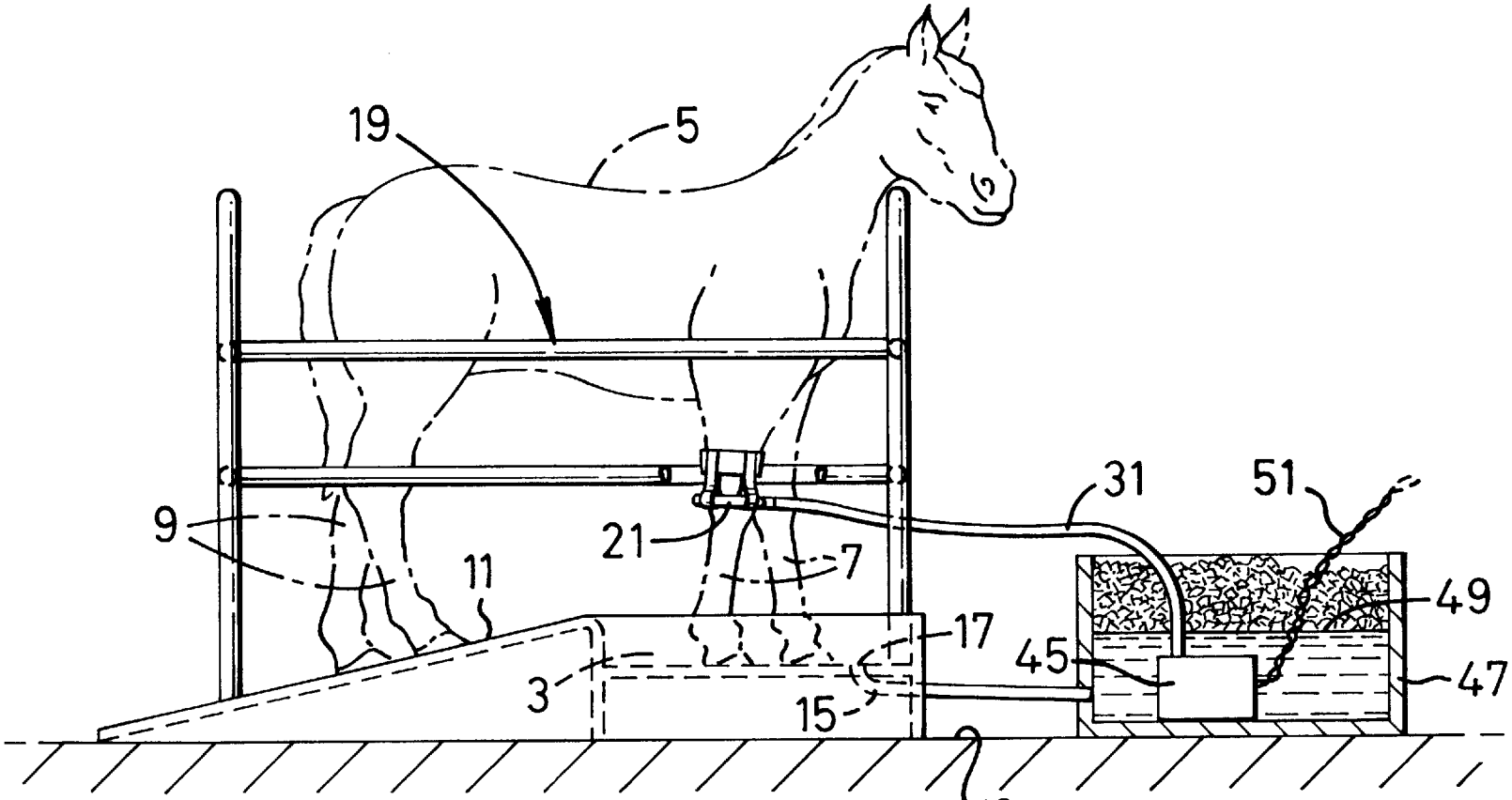
FIG. 1 is a diagrammatic side view of one form of treatment apparatus in accordance with the invention.
Figure 2:
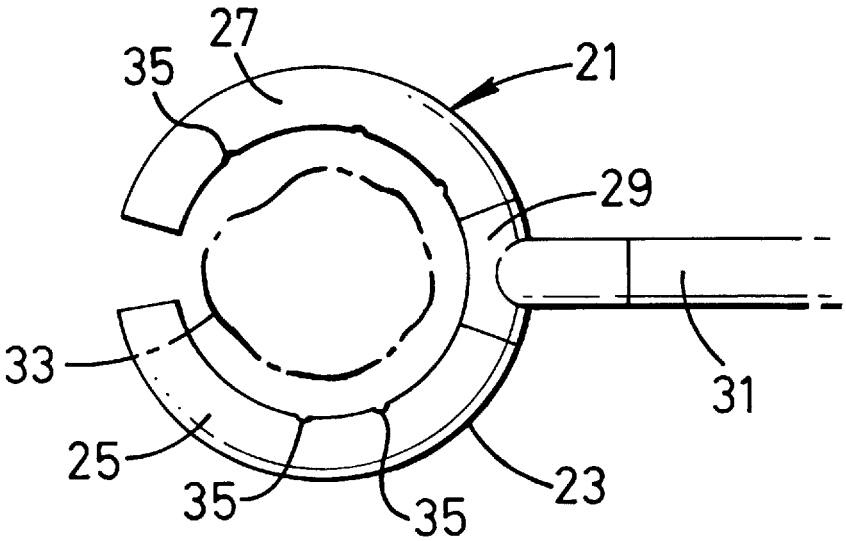
FIG. 2 is a plan view of a spray head for the apparatus as shown in FIG. 1.
Figure 3:
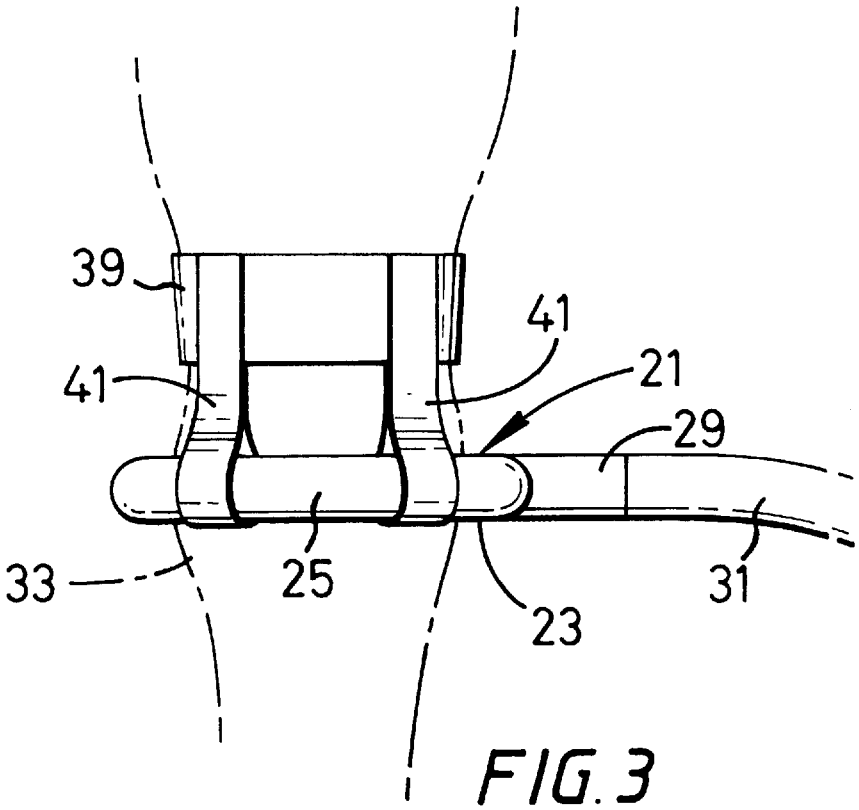
FIG. 3 is a side view of the spray head of FIG. 2.

Referring to FIGS. 1 to 3 of the drawings, there is shown one embodiment of an animal treatment apparatus in accordance with the invention.

It is to be understood that the purpose of the apparatus shown is intended for use with horses and will be so described Nevertheless, it will be appreciated that the apparatus or modifications thereof could be used for treating the limbs of other animals such as farmyard animals or even household pets.

The apparatus shown comprises a shallow trough 3 in which the horse to be treated, indicated diagrammatically in broken lines at 5, is intended to stand. In order to keep the dimensions of the equipment to a minimum, it is intended that only the front legs 7 or the hind legs 9 of the horse 5 can be positioned in the trough 3. Access to the trough is had by means of a ramp 11 up which the horse 5 can be lead or backed depending on which leg requires treatment. The trough 3 must be of a minimum height off the ground 13 as it is necessary to have a drain pipe 15 tberebeneath as will be explained hereafter, the drain pipe 15 having access to a drain hole 17 in the base of the trough 3.

The ramp 5 together with the trough 3 are provided with a restraining frame, indicated diagrammatically at 19, which prevents the horse 5 from moving out of the trough 3 although the horse can still move in the general sense, i.e. flex it legs, move its head and tail etc.

To the leg of the horse to which treatment is to be applied is attached a spray head 21 of which more details are shown in FIGS. 2 and 3. The spray head 21 comprises a two part flexible hose arrangement 23 having a first side 25 and a second side 27. The two sides 25 and 27 are connected together by a "T" joint 29 and to a feed hose 31. The two sides 25 and 27 are intended to encircle the horse's leg, indicated diagrammatically at 33 at a position at or above the injury and are provided with a plurality of perforations 35 directed inwardly towards the leg 33 so as to spray water onto the leg either onto the injury itself or above the injury so that the water will run down over the injured portion of the leg.

The spay head is supported on the horses leg by means of a belt 39 which is passed around the horses leg and fastened, for example, by VELCRO in a similar manner to that used in blood pressure measuring equipment. The belt 39 carries a plurality of depending loops 41 in which the hose sides 25 and 27 are located. It will be appreciated that when the hose sides are located in position they will encompass an area larger than that of the cross section than that of the horses leg so that they stand away from the surface of the leg to promote spraying.

Returning now to FIG. 1, the feed hose 31 is connected to an electric pump 45 which is situated in a container 47 which contains cold water with a water level 49 above the level of the pump intake. To the lower part of the container 47 is connected the drain pipe 15 from the trough 3 so as to re-circulate the water being sprayed from the container 47 onto the horse's leg via the spray head 21. Suitably, the upper part of the container 47 is filled with ice so as to keep the recirculating water cold A lead 51 is provided whereby the pump 45 is connected to an electricity supply.

The operation of the apparatus described above will now be considered:

When a horse has injured itself and requires treatment to prevent swelling of one of its legs, the apparatus is set up as shown in FIG. 1. The container 47 is filled with water up to a level above the pump 45 and the remainder of the container 47 is filled with ice.

The injured horse is led up the ramp 11 until the hoof of its injured leg is located in the trough 3. The spray head 21 is then attached to the horses leg above the injured portion by spreading the two hose sides 25 and 27 so that they can pass around the horses leg and are retained in position by means of the belt 39.

The pump is then switched on and water is pumped through the feed hose 31 to the spray head 21, spraying cold water on to the horses leg through the perforations 35 so as to cool the injured part and prevent swelling. The ice in the container 47 will gradually melt into the water keeping it cold. The water which has been sprayed on the horse's leg will run off into the trough 3 and be passed back to the container 47 by way of the drain hole 17 and drain pipe 15. Thus the treatment can be continued as long as necessary using the same water recirculated.

While the above described embodiment is intended for treating a single limb, it will be appreciated that it is some times necessary to treat two limbs at the same time, for example, both fore legs or both hind legs. In theses circumstances, a second spray head (not shown) could be provided, the output of the pump 45 being connected to a 'T' piece to the ends of the cross piece of which are connected the two feed lines 31. In theory, the apparatus could be used for treating a number of animals at the same time, and thus additional spray heads could be used.

Figure 4:
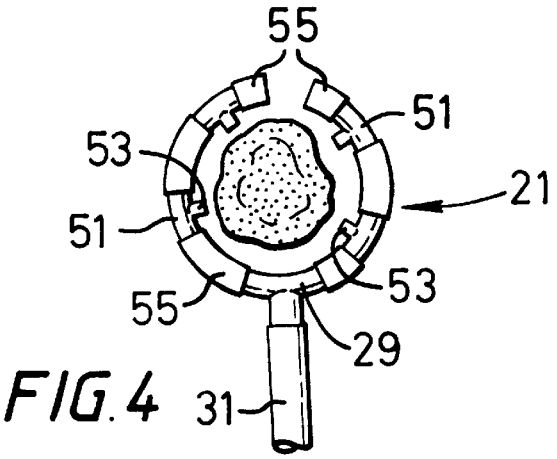
FIG. 4 is a view similar to FIG. 2 but showing a second form of spray head.

FIG. 4 shows an alternative form of spray head 21 to that shown in FIG. 2. In this embodiment, individual nozzle members 51 having nozzles 53 are connected together and to the 'T' joint 29 by means of individual lengths of tubing 55. In this way, the number of nozzles used can be varied. The nozzle members are individually rotatable about their major axes so that the jet of water from each nozzle can be individually directed.

Figure 5:
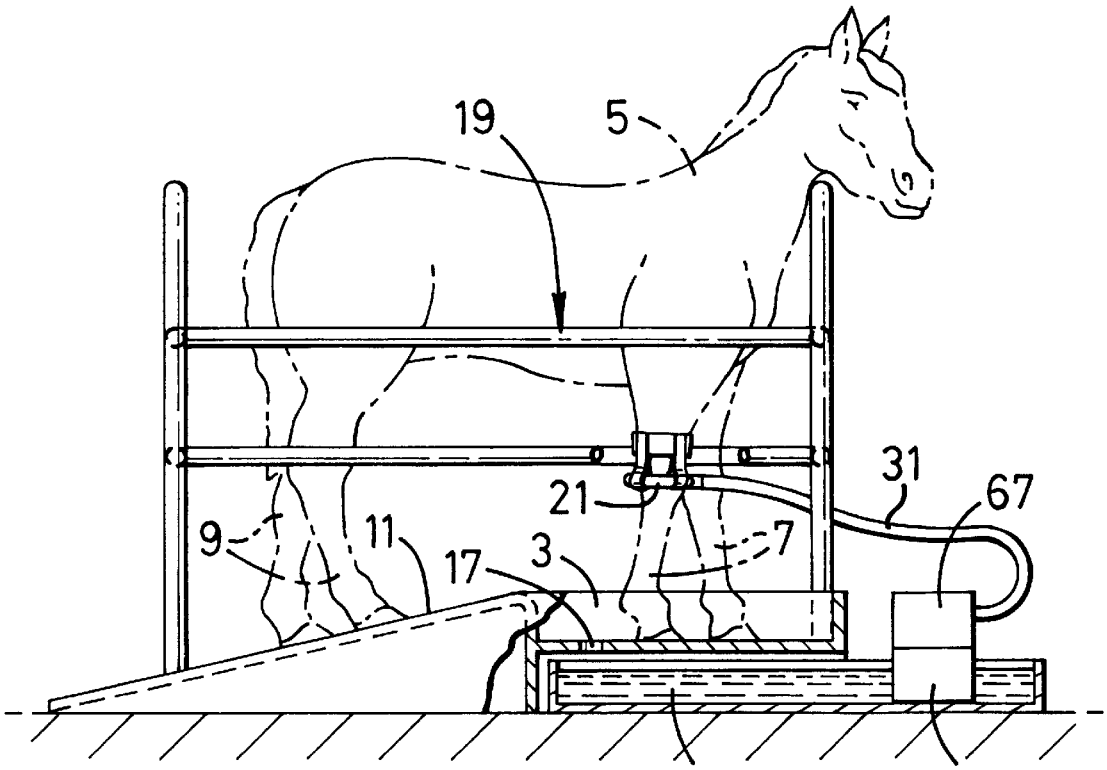
FIG. 5 is a view similar to FIG. 1 but showing a second form of the apparatus in accordance with the invention.

FIG. 5 shows an alternative and more compact form of the apparatus. In this form of apparatus, instead of providing a container separate from the trough 3, a relatively shallow tray 61 is provided of which the major part lies underneath the trough. The tray extends out from under the trough 3 to enable a pump 63 to be located therein. The trough 3 is provided with its drain hole 17 towards the rear and directly feeds straight into the tray 61, thus enabling the drain pipe 15 to be dispensed with. Because of the shallowness of the tray 61, a portable pump 63 is used, only the inlet parts of the pump lying in the tray 61, the main drive mechanism, indicated at 67, being located above the water level.

Ice as necessary can then be placed in that part of the tray which lies under the trough 3. The use of this arrangement facilitates dismantling of the apparatus since, once treatment has finished and the majority of the water has been pumped out by the pump, the pump 63 can be simply lifted out of the tray 61. This allows the tray 61 to be withdrawn and any water remaining in the tray can easily be emptied The apparatus of this embodiment operates exactly the same as the apparatus shown in FIG. 1.

It will be appreciated that various alterations may be made to the above described embodiment without departing from the scope of the invention. For example, in a more compact, if less accessible arrangement, the container 47 could be positioned under the trough 3, the re-circulating water then passing directly from the drain hole 17 into the container 47 without the interposition of the drain pipe 15. If desired, a battery driven pump could be used instead of the mains driven pump described.

It will be also understood that, while the normal use of the apparatus is to spray cold water onto the injury, some treatments may require the use of warm or even hot water. A disinfectant can be added to the water where the animal has cuts and lacerations as well as a swelling.

While the invention has been described for use in treating animal limbs, it will be appreciated that, with a little ingenuity, the apparatus could be used to provide a recirculating spray for other parts of the body.

I claim:

1. An animal treatment apparatus comprising a shallow trough for location of at least one limb of an animal to be treated, a container for containing water, a nozzle for aiming water from said container at an injured area of the body of said animal attachment means for attachment of said nozzle to the animal's body correctly aligned with said injured area, conveying means for conveying said water from said container to said nozzle, said trough defining a receptacle for collecting said water after it has been sprayed on to the body of said animal and return means for returning said water from said trough to said container.

2. An apparatus as claimed in claim 1 wherein said shallow trough has a suitably located drain hole and a floor which drops towards said drain hole.

3. An apparatus as claimed in claim 2, wherein said drain hole is located directly over said container and forms said return means.

4. An apparatus as claimed in claim 3, wherein, where the apparatus is intended for use with quadrupeds, the trough is large enough to take the whole animal.

5. An apparatus as claimed in claim 3, wherein, where the apparatus is intended for use with quadrupeds, the trough is large enough to take front or back legs of the animal.

6. An apparatus as claimed in claim 3, anther comprising a ramp at the upper end of which said trough is located so that the animal can walk up said ramp to gain access to said trough.

7. An apparatus as claimed in claim 1, further comprising restraining means to retain the animal in location in respect to said trough.

8. An apparatus as claimed in claim 1, wherein said attachment means comprises means for attachment to a limb of said animal.

9. An apparatus as claimed in claim l, wherein said water is cold water.

10. An apparatus as claimed in claim 1, wherein said water is hot water.

11. An apparatus as claimed in claim 1, wherein said container carries ice therein so that said water is cooled on each circulation thereof.

12. An apparatus as claimed in claim 1, wherein a plurality of nozzles are provided, aimed in different directions, so as to increase the area which is covered by the water.

13. An apparatus as claimed in claim 12, wherein said nozzles are provided along a flexible piping which can be bent to pass substantially around the limb of an animal.

14. An apparatus as claimed in claim 13, further comprising a harness attachable to a limb of an animal, said piping being suspended from said harness.

15. An apparatus as claimed in claim 14, wherein said harness comprises two ends defining an opening portion at one side, securing means being provided for releasably securing together said two ends of said harness.

16. An apparatus as claimed in claim 15, wherein said securing means comprise a buckle arrangement.

17. An apparatus as claimed in claim 16, wherein said securing means comprise a hook and loop fastening means.

18. An apparatus as claimed in claim 12, further comprising individual nozzle members, each carrying a said nozzle, and flexible piping for connecting said nozzles together so that the piping, together with the nozzle members, can be bent to pass substantially around the limb of an animal.

19. An apparatus as maimed in claim 18 wherein said nozzle members are independently adjustable so that the streams of water provided thereby can be directed individually.

20. An apparatus as claimed in claim 18, further comprising a harness attachable to a limb of an animal, said piping and said nozzle members being suspended from said harness.

21. An apparatus as claimed in claim 20, wherein said harness comprises two ends defining an opening portion at one side, securing means being provided for releasably securing together said two ends of said harness.

22. An apparatus as claimed in claim 21, wherein said securing means comprise a buckle arrangement.

23. An apparatus as claimed in claim 21, wherein said securing means comprise a hook and loop fastening means.

24. An apparatus as claimed in claim 1, further comprising a plurality of said nozzle means, each for treating one of a plurality of areas of an animal.

* * * * *